United States Patent [19]

Seaman

[11] Patent Number: 4,502,399

[45] Date of Patent: Mar. 5, 1985

[54] BELT LOOP SEWING APPARATUS

[75] Inventor: A. Matthew Seaman, Brentwood, Tenn.

[73] Assignee: Cutters Exchange, Inc., Nashville, Tenn.

[21] Appl. No.: 533,537

[22] Filed: Sep. 19, 1983

[51] Int. Cl.[3] ..... D05B 3/12; D05B 35/00

[52] U.S. Cl. ..... 112/121.27; 112/104

[58] Field of Search ..... 112/121.27, 121.26, 112/121.15, 152, 104, 121.12, 147; 223/37

[56] References Cited

U.S. PATENT DOCUMENTS

| | | | |
|---|---|---|---|
| 3,095,842 | 7/1963 | Metzger | 112/121.27 X |
| 3,777,684 | 12/1973 | Friedman et al. | 112/121.27 X |
| 4,005,663 | 2/1977 | Barthelmes | 112/121.27 X |
| 4,048,931 | 9/1977 | Hodgins | 112/121.27 |
| 4,114,544 | 9/1978 | Miyachi et al. | 112/121.27 X |
| 4,137,857 | 2/1979 | Miyachi et al. | 112/121.27 |
| 4,287,842 | 9/1981 | Breck, Jr. | 112/121.27 |
| 4,389,957 | 6/1983 | Block et al. | 112/121.27 X |
| 4,393,800 | 7/1983 | Hargett | 112/121.27 X |

*Primary Examiner*—Hampton H. Hunter

*Attorney, Agent, or Firm*—Harrington A. Lackey

[57] ABSTRACT

A belt loop sewing apparatus including a stitching machine having a stitching station and shiftable clamps for moving a belt loop in the stitching station between two stitching positions, and a loading apparatus. The loading apparatus includes a pair of turning finger members mounted at the end of a pair of longitudinally reciprocable turning rods adapted to receive and carry a belt loop strip from the loading position to the stitching station. The turning rods are mounted in a pair of spiral cam devices capable of causing the rods to rotate through approximately 270° to turn the ends of the belt loop strip and deliver it to the stitching station, in a single, continuous operation.

7 Claims, 5 Drawing Figures

BELT LOOP SEWING APPARATUS

BACKGROUND OF THE INVENTION

This invention relates to a belt loop sewing apparatus, and more particularly to an apparatus for loading a belt loop strip upon a sewing machine.

Apparatus for forming and attaching belt loops to garments are well-known in the art, as illustrated in the following U.S. patents:

U.S. Pat. No. 3,095,842—Metzger—Jul. 2, 1963
U.S. Pat. No. 4,005,663—Barthelmes—Feb. 1, 1977
U.S. Pat. No. 4,048,931—Hodgins—Sep. 20, 1977
U.S. Pat. No. 4,114,544—Miyachi et al—Sep. 19, 1978
U.S. Pat. No. 4,137,857—Miyachi et al—Feb. 6, 1979
U.S. Pat. No. 4,287,842—Breck, Jr.—Sep. 8, 1981

The above Hodgins patent, both Miyachi patents, and the Breck patent disclose apparatus for forming and attaching belt loops to pants or jeans.

The above Hodgins and both Miyachi patents disclose belt loop forming apparatus including rotary finger members adapted to support and turn the opposite ends of the belt loop strip and to transfer the belt loop strip to a sewing machine for stitching the belt loop upon a pair of pants.

Hodgins, both Miyachi patents and Breck disclose slidable plates on the bed or platform of the sewing machine actuated by a pneumatic cylinder for positioning each turned end of the belt loop beneath the needle in the sewing station.

The Hodgins and both Miyachi patents disclose seam detectors for sensing and eliminating a belt loop strip including a spliced or seamed portion, before it can be processed to form a belt loop.

The turning tines disclosed in the Hodgins and both Miyachi patents are rotated by a rack and gear mechanism so that the rotation occurs while the belt loop strip is in a stationary position. Only after the ends are turned, is the entire belt loop strip transferred to the stitching station.

Although the Breck, Jr. U.S. Pat. No. 4,287,842, discloses a pair of turning rods having a cam for cooperation with a spiral cam follower in order to rotate the turning rods to form turned ends of a belt loop, nevertheless, the rods remain longitudinally stationary while the spiral cam member is in motion to cause the turning plates to cooperate with a stationary platform in order to turn the ends of the belt loop strip. After the ends of the belt loop strip are turned in a stationary position, then a separate longitudinal motion of the rods is required to transfer the turned loop to the stitching station.

SUMMARY OF THE INVENTION

It is therefore an object of this invention to provide in a belt loop sewing machine, a loading or transfer apparatus in which the belt loop strip, cut to a predetermined length, is received initially by the fingers of the turning or folding mechanism. In a single continuous motion, the ends of the belt loop strip are turned for stitching, while the belt loop strip is transferred from the loading station to the stitching station, thus accomplishing in one operation what has previously been accomplished in two operations.

More specifically, the turning or folding apparatus includes a pair of turning finger members supported on the respective free ends of a pair of longitudinally reciprocable turning rods which are operatively connected to a linear motor or pneumatic cylinder capable of transferring the turning finger members from a loading station continuously to the stitching station.

The turning rods are reciprocably and longitudinally mounted within a pair of stationary, elongated, hollow guide cylinders, or tubular guide members in which are formed oppositely directed spiral cam slots extending approximately three-fourths of the circumference of each corresponding tubular guide member. Received in each cam slot is a radial cam element projecting from each of the turning rods. Thus, as the linear motor protracts the turning rods and the turning fingers, carrying a belt loop strip, toward the stitching station, the spiral cams cause the turning rods to simultaneously rotate in opposite directions to form the turned ends of the belt loop strip.

A shift plate member is mounted on the stitching platform to sequentially position each turned end of the belt loop beneath the needle of the sewing machine.

The belt loop strips are fed to the loading station by any desired feeding mechanism, and if fed in a continuous strip, a knife member is provided for cutting the continuous strip into predetermined lengths. The belt loop loading apparatus made in accordance with this invention may be incorporated with a conventional or existing industrial sewing machine capable of stitching the ends of the belt loop strips to a garment, such as a pair of pants.

DESCRIPTION OF THE PREFERRED EMBODIMENT

Figures 1, 4, 5:
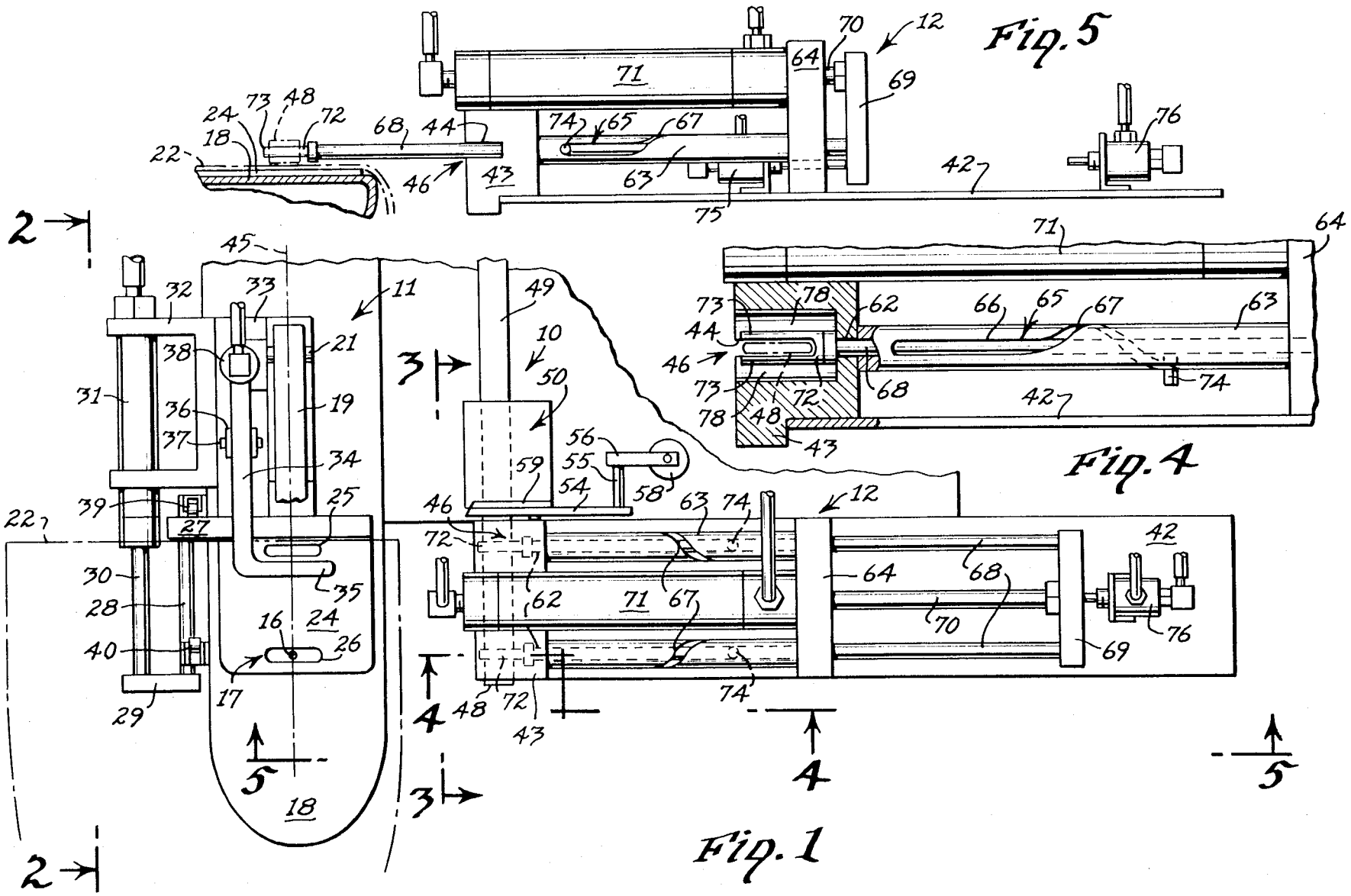
FIG. 1 is a top plan view of a belt loop sewing apparatus incorporating a loading apparatus made in accordance with this invention.
FIG. 4 is an enlarged fragmentary section taken along the line 4—4 of FIG. 1.
FIG. 5 is an enlarged fragmentary section taken along the line 5—5 of FIG. 1.

Referring now to the drawings in more detail, FIG. 1 discloses a belt loop sewing apparatus 10, including the combination of a belt loop sewing machine 11 and a loading apparatus 12.

The sewing machine 10 includes an arm 14 in which is reciprocably mounted a needle bar 15 carrying a needle 16 for vertical reciprocable movement in a sewing station 17 over a platform 18. The needle bar 15 is reciprocably driven by the sewing machine 10 in a known manner.

Figure 2:
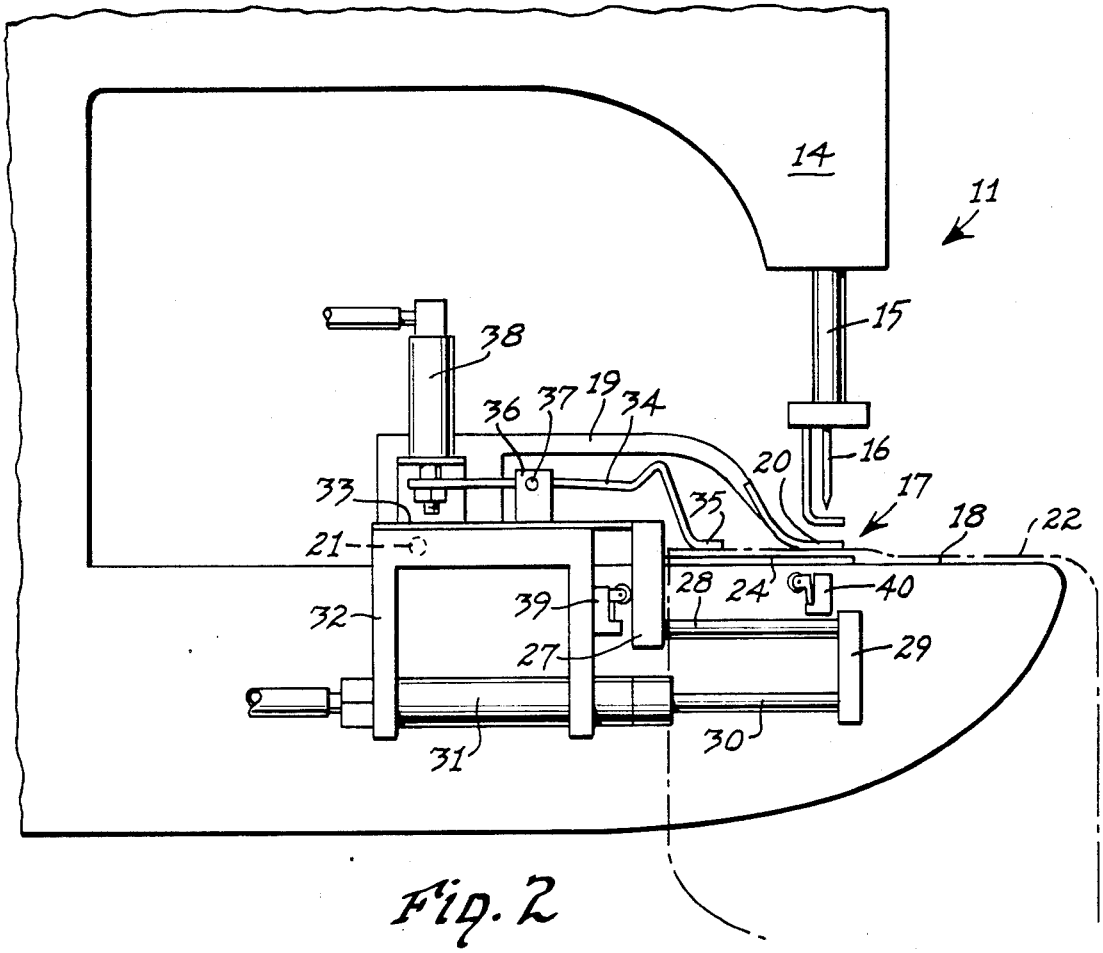
FIG. 2 is a fragmentary elevational view taken along the line 2—2 of FIG. 1.

The platform 18 carries a presser foot arm 19 supporting a presser foot 20. The opposite end of the presser foot arm 19 is pivotally mounted by pin 21 to a stationary part of the machine 11, such as the platform 18. The presser foot 20 operates in a conventional manner for clamping the work piece, such as a garment or pair of pants 22, illustrated in FIGS. 1 and 2, during the stitching operation.

Mounted for slidable movement longitudinally of the platform 18, is a shift plate 24 having a pair of longitudinally spaced transverse needle openings 25 and 26. The shift plate 24 is fixed to a transverse bar 27. Projecting forward from the bar 27 is a rod 28 connected to a cross head 29, which is in turn connected to a piston rod 30 reciprocable within the pneumatic cylinder 31 carried by the cylinder bracket 32 which is fixed to the platform 18. Extending rearwardly from the transverse bar 27 is a rear slide plate 33, which moves longitudinally and reciprocably with the transverse bar 27. The slide plate 33 supports a longitudinally extending auxiliary arm, the free end of which constitutes an auxiliary clamp 35. The auxiliary arm 34 is pivotally mounted on a block 36 by a pivot pin 37. The rear end of the auxiliary arm 34 is adapted to be retracted upward by an auxiliary cylinder 38 fixed to the rear side plate 33.

Limit switches 39 and 40 may be provided on the side of the platform 18 to limit the longitudinal travel of the transverse bar 27, and thereby the longitudinal movement of the shift plate 24.

The loading apparatus 12 includes a support plate 42 upon one end of which is mounted a receiver head 43. The receiver head 43 includes an elongated receiver slot 44 extending longitudinally and parallel to the longitudinal axis 45 of the stitching station 17. Both ends of the slot 45 are open, as well as the side opposing the sewing machine 11, to define a loading station 46, for receiving an elongated belt loop strip 48 cut to a predetermined length.

Figure 3:
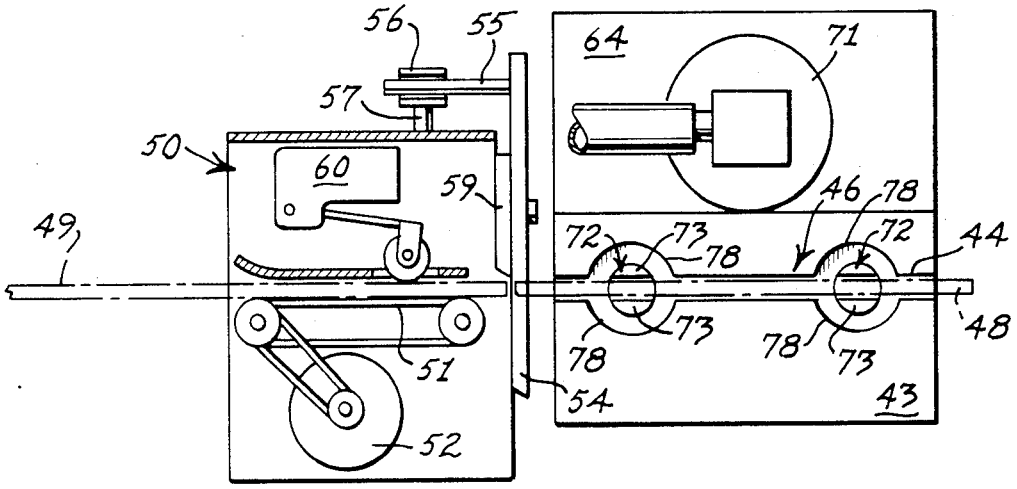
FIG. 3 is a fragmentary sectional elevation taken along the line 3—3 of FIG. 1.

In order to form the belt loop strip 48, an elongated web of belt loop material 49 is fed into the rear end of the slot 44 by any convenient type of web feeding device, such as the device 50 disclosed in FIG. 3 including an endless feeder belt 51 driven by a motor 52.

Between the feeder device 50 and the receiver head 43 is pivotally mounted a movable knife blade 54 adapted to be actuated through the link rod 55, clevis 56, and piston rod 57 driven by the pneumatic cylinder 58. The movable knife blade 54 cooperates with a fixed knife blade 59 to cut the web 49 to produce the belt loop strip 48 of the desired length for securing to the garment 22.

A seam detector of any conventional type, such as the seam detector 60, may also be utilized in the feeder device 50 to detect enlarged thicknesses in the web 49, such as splices. The seam detector 60 is connected into the control system of the apparatus 10 for rejecting a section of the belt loop web 49 including such an enlarged thickness, in a well-known manner.

A pair of cylindrical rod passageways 62 are formed in the side wall of the receiver head 43, parallel to each other and opening into the slot 44. Fixed to and projecting coaxially from the passageways 62 are a pair of parallel tubular guide members, preferably cylindrical and hollow. The right ends of the cylindrical guide members 63, as viewed in FIG. 1, are supported by a block 64.

Formed in each cylindrical wall of the tubular guide member 63 is a cam slot 65 which has a straight portion 66 and a spiral portion 67. The spiral portion 67 extends about three-fourths of the circumference of the cylindrical guide member, as best disclosed in FIGS. 4 and 5.

The straight cam slot portions 66 are located on the opposite sides of the respective tubular guide members 63 from each other. The spiral cam slot portions 67 curve in opposite directions from each other over the tops of the cylindrical support guide members and terminate in the bottom walls of the respective guide members 63. Received in each of the tubular guide members 63 for longitudinal coaxial reciprocal movement is an elongated turning rod 68. Each turning rod 68 extends through the respective rod passageway 62 and into the slot 44. The opposite ends of the rods 68 are connected to a cross head 69, which in turn is connected to a piston rod 70 reciprocable within a pneumatic cylinder 71. Thus, by actuation of the fluid cylinder 71, the rods 68 are caused to reciprocate coaxially within the respective cylindrical guide members 63.

The free end of each of the turning rods 68 terminate in respective turning finger members 72. Each turning finger member 72 includes a pair of spaced elongated fingers or tines 73 (FIG. 4) projecting toward the sewing station 17. In the retracted position of the turning rods 68, the tines 73 of each turning finger member 72 are preferably positioned in vertical alignment within the slot 44, so that, as the belt loop web 49 is fed longitudinally through the slot 44, the web is received, not only in the slot 44, but also between both pairs of tines or fingers 73.

Each turning rod 68 is provided with a cam or cam stud 74 projecting radially from the respective turning rod 68 and received within the cam slot 65. Thus, as each turning rod 68 travels longitudinally through the corresponding tubular guide member 63, its cam 74 travels in the direction of the sewing station 17, first within the spiral slot portion 67 and then through the straight portion 66.

Accordingly, each turning rod 68 will be caused to rotate through approximately 270° as the rods move toward the stitching station 17, causing their respective turning finger members 72 to rotate. Since the turning finger members 72 are located at the opposite ends of the belt loop strip 48, the opposite end portions of the strip 48 are turned downward and inwardly toward each other by the rotating fingers 73. The rotation of each finger member 72 is simultaneous with the longitudinal travel of the respective turning rod 68 toward the stitching station 17.

The straight portions 66 of the cam slots 65 cause the finger members 72 to complete their travel toward the stitching station 17 and to hold the belt loop strip 48 with the turned ends in such a manner that the tines 73 remain substantially horizontal.

The cylinder 71 is programmed so that the turning finger members 72 arrive in the stitching station 17 in substantial alignment with the longitudinal axis 45.

The limit of travel of the turning rods 68 is determined by the limit valve switches 75 and 76 (FIG. 5).

In order to insure that the lower tines 73, in each of the turning finger members 72, has its top surface flush with the bottom surface of the slot 44, the slot 44 may be provided with the upper and lower arcuate recesses 78, disclosed in FIG. 3, for receiving the upper and lower tines. Thus, the web 49 may be fed through the slot 44 without the tines 73 interfering with the passage of the web.

In the operation of the apparatus 10, the shift plate 24 is normally in its rearward position as disclosed in FIG. 1 and the finger members 72 are in their retracted positions seated within the slot 44 as disclosed in FIGS. 1 and 4. A web of belt loop material 49 is fed through the feeder device 50 and into the slot 44 in the loading station 46. The web 49 is then cut by the cooperating knife blades 54 and 59 to form the belt loop strip 48 of predetermined length.

The belt loop strip 48 in the loading position has its opposite end portions received between the tines 73 of the respective turning members 72. The tines 73 are long enough to adequately support the belt loop strip 48 as the turning members 72 travel toward the stitching station 17.

The controls then actuate the cylinder 74 to retract the piston rod 70 and protract the turning rods 68 toward the stitching station 17. As the turning members 72 are protracted from the slot 44, the spiral cams 67 cause the cam stud 74 to rotate, thus causing the turning rods 68 to rotate as they simultaneously move longitudinally through the guide cylinders 63. The rotation of the turning rods 68 cause the finger members 72 to rotate in opposite directions to turn the ends of the strip 48 downward and inward, and the rods 68 continue to protract until the finger members 72 deliver the belt loop strip 48 with its turned ends at the stitching station 17 with the forward turned end of the strip 48 beneath the needle 15. The presser foot arm 19 is caused to descend by conventional controls within ghe sewing machine 11 to clamp the forward end of the strip 48 beneath the needle 15, and the controls are also actuated to cause the pneumatic cylinder 38 to depress the auxiliary clamp 35 to hold the rear end of the strip 48 adjacent the elongated needle hole 25. The cylinder 78 is then caused to protract to retract the rods 68 and the finger members 73 causing them to move longitudinally and simultaneously counter-rotate through 270° until the finger members 72 are returned to the loading station within the slot 44. The needle 15 is then actuated to stitch the front turned end of the belt loop strip 48. Upon completion of the stitching, the shift cylinder 31 protracts to move the shift plate 24 forward by an increment, determined by the limit switch valves 39 and 40, to place the rear turned end of the belt loop strip 48 over the needle hole 25 beneath the needle 15. Stitching is then resumed to secure the rear turned end of the belt loop strip 48 to the pants 22. After the second stitching is completed, the pants 22 are shifted to a position for sewing the next belt loop, and the cycle is repeated.

It is therefore apparent that a belt loop sewing apparatus 10 has been produced which includes a loading apparatus 12 capable of receiving a predetermined length of belt loop strip, turning the ends, and delivering the strip to the sewing station in one continuous movement, and in a single operational step.

What is claimed is:

1. An apparatus for securing a belt loop to a garment, comprising;

(a) a securing station including a platform, having a longitudinal axis, for supporting a garment, and securing means for attaching to the garment in a securing position longitudinally of said platform, a belt loop having opposite ends, (b) means for shifting the garment longitudinally on said platform to permit the securing means to attach each end of the belt loop to the garment, (c) a belt loop loading device mounted adjacent said securing station, (d) said loading device comprising a receiver head adapted to receive a belt loop strip substantially parallel to said longitudinal axis, in a loading position, (e) a feeder device for feeding a belt loop strip of predetermined length to said loading position, (f) a pair of parallel hollow tubular guide members fixed to said receiver head and projecting transversely away from said securing station, (g) an elongated turning rod reciprocably received coaxially within each of said tubular guide members, each rod having a free end proximal to said securing station, (h) a turning finger member projecting from each of said free ends, (i) said turning finger members being adapted to receive the opposite end portions of said belt loop strip in said loading position, to carry said belt loop strip to said securing station as said turning rods move toward said securing station, and to turn the ends of said belt loop strip, as said turning rods rotate about their longitudinal axes, to form a belt loop, (j) an elongated spiral cam slot in the wall of each of said tubular guide members, having opposite spiral directions from each other, (k) a cam member projecting radially from each turning rod and received in said corresponding spiral cam slot, (l) linear motor means for driving said turning rods simultaneously between a retracted position in which said turning finger members are in registry with said receiver head for receiving said belt loop strip in said loading position, and a protracted position in which said turning finger members deliver the belt loop in said securing station, the end portions of said belt loop strip being turned in opposite directions by said turning finger members as said turning rods travel between said retracted position and said protracted position.

2. The invention according to claim 1 in which each of said spiral cam slots extend approximately three-fourths of the circumference of each of said corresponding tubular guide members, whereby said turning finger members are each rotated through approximately 270° during the travel of said rods from said retracted position to said protracted position.

3. The invention according to claim 1 in which said turning rods travel continuously, and uninterruptedly from said retracted position to said protracted position.

4. The invention according to claim 1 in which said receiver head comprises an elongated receiver slot substantially parallel to said longitudinal axis having open ends and opening toward said securing station for receiving a belt loop strip longitudinally within said receiver slot in said loading position, the reciprocal longitudinal paths of said turning finger members intercepting said receiver slot.

5. The invention according to claim 4 in which said turning finger members normally lie within said receiver slot in said retracted position, so that a belt loop strip fed through one end of said receiver slot lies upon said turning finger members in said retracted position when said strip is in said loading position.

6. The invention according to claim 5 in which guide openings are formed in said receiver head for longitudinally receiving said turning rods.

7. The invention according to claim 4 in which each of said turning finger members comprises a pair of tines projecting toward said securing station and spaced apart sufficiently to receive between said tines a belt loop strip in said loading position when said rods are in said retracted position.

* * * * *